United States Patent [19]

Becker et al.

[11] Patent Number: 4,723,222

[45] Date of Patent: Feb. 2, 1988

[54] OPTICAL CORRELATOR FOR ANALYSIS OF RANDOM FIELDS

[75] Inventors: Roger J. Becker, Kettering; Allan Buswell, Dayton, both of Ohio; Mustafa A. Al-Saffar, Al-Nuzha, Kuwait

[73] Assignee: The United States of America as represented by the Secretary of the Air Force, Washington, D.C.

[21] Appl. No.: 881,420

[22] Filed: Jun. 27, 1986

[51] Int. Cl.[4] ..... G09G 9/00

[52] U.S. Cl. ..... 364/822; 364/604; 350/162.13

[58] Field of Search ..... 356/71, 141, 390; 350/162.13, 96.26, 162.14; 250/201; 364/822, 604, 819

[56] References Cited

U.S. PATENT DOCUMENTS

| | | | |
|---|---|---|---|
| 3,305,834 | 2/1967 | Cooper et al. | 340/146.3 |
| 3,398,269 | 8/1968 | Williams | 235/181 |
| 3,519,992 | 7/1970 | Rau | 340/146.3 |
| 3,544,197 | 12/1970 | Weaver | 350/162 |
| 3,768,907 | 10/1973 | Williams | 356/71 |
| 4,000,949 | 1/1977 | Watkins | 356/165 |
| 4,063,799 | 12/1977 | Bernstein et al. | 350/162 SF |
| 4,158,503 | 6/1979 | Balasubramanian | 356/71 |
| 4,163,148 | 7/1979 | Fritsche | 350/96.26 |
| 4,514,038 | 4/1985 | Pichon | 350/162.13 |
| 4,637,056 | 1/1987 | Sherman | 364/822 |
| 4,669,054 | 5/1987 | Schlunt | 364/822 |

*Primary Examiner*—Michael R. Fleming

*Attorney, Agent, or Firm*—Bobby D. Scearce; Donald J. Singer

[57] ABSTRACT

An optical data correlator for the analysis of images of random fields is provided which comprises a light source for projecting a beam of light along a preselected optical axis, a first lens system for receiving the beam and focusing it onto a first image, a second lens system for receiving light transmitted by the first image and focusing the light so transmitted onto a second image, a third lens system for receiving light transmitted by the second image and projecting this transmitted light onto a photodetector, and suitable electronics including an amplifier and an analog-to-digital converter for analyzing the output of the photodetector and displaying the output in useful form. Spatial filters may be included to define the projected beam, and an alignment system preferably attachable to the second image may be included to selectively position the second image.

10 Claims, 3 Drawing Figures

OPTICAL CORRELATOR FOR ANALYSIS OF RANDOM FIELDS

RIGHTS OF THE GOVERNMENT

The invention described herein may be manufactured and used by or for the Government of the United States for all governmental purposes without the payment of any royalty.

BACKGROUND OF THE INVENTION

The invention relates generally to systems for processing optical data, and more particularly to an optical correlator for providing quantitative data on image reduction of random fields.

Motion pictures are extremely useful in obtaining information on behaviour of flow fields such as generated within a wind tunnel, propulsion system, spray, or other turbulent flow system, and which characterizes deflagrating surfaces of combusting systems. A photograph presents substantial detailed information and therefore, reduction of data contained in a movie presents a formidable data reduction problem. This problem has substantially limited the use of movies to a qualitative visual understanding of the phenomena under study. A need therefore exists for a system for reducing images of substantially quasirandom fields to quantitative data.

In the quantitative analysis of images of random fields, such as that of deflagrating solid rocket propellant surfaces, digital computer systems are generally not suitable, since digital systems handle only digital data and process data serially and relatively slowly. In particular, image analysis by a digital system requires point-by-point analog-to-digital (A/D) conversion and serial operations; the light output of the image must first be converted into digital numbers and stored, and this process repetitively performed to cover the entire image. Since the detail of a single motion picture frame may exceed $10^6$ pixels, the memory store for a multiplicity of frames comprising a movie is large, which may preclude use of digital analysis for data reduction of random fields.

The present invention provides an optical correlator for quantitative analysis of images of random flow fields such as those mentioned above. The invention comprises an analog optical data processing system including a series of lenses to perform optical operations on random field images under examination, and allow the examination of an entire image at once, i.e., performs parallel data processing by mapping one two dimensional data field onto another simultaneously. The correlator is simple and economical in structure and operation and has extremely fast response time, especially in data reduction of photographs or movies. A quantitative description of the correlation function of a random flow field image may be conveniently obtained.

It is therefore a principal object of the invention to provide an improved optical data correlator.

It is a further object of the invention to provide an optical data correlator for quantitative analysis of random field images.

It is another object to procide an optical data correlator for analysis of combustion systems and other turbulent flow systems.

These and other objects of the invention will become apparent as the detailed description of representative embodiments proceeds.

SUMMARY OF THE INVENTION

In accordance with the foregoing principles and objects of the invention, an optical data correlator for the analysis of images of random fields is provided which comprises a light source for projecting a beam of light along a preselected optical axis, a first lens system for receiving the beam and focusing it onto a first image, a second lens system for receiving light transmitted by the first image and focusing the light so transmitted onto a second image, a third lens system for receiving light transmitted by the second image and projecting this transmitted light onto a photodetector, and suitable electronics including an amplifier and an analog-to-digital converter for analyzing the output of the photodetector and displaying the output in useful form. Spatial filters may be included to define the projected beam, and an alignment system preferably attachable to the second image may be included to selectively position the second image.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
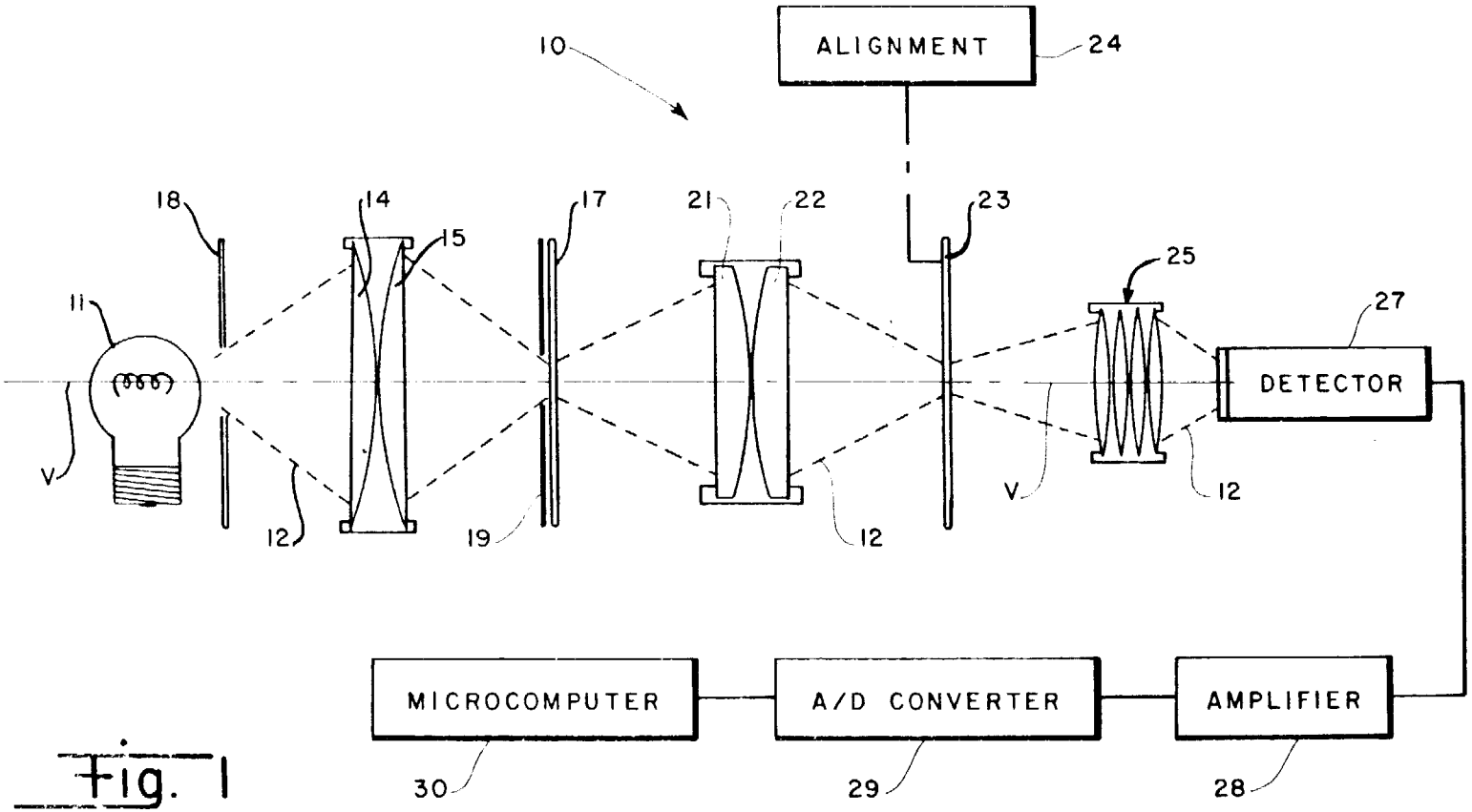
FIG. 1 is a schematic of a representative arrangement of optical components and associated detector and data processing equipment comprising the optical correlator of the invention.

Referring now to FIG. 1, shown therin is a schematic of a representative arrangement of the optical correlator system 10 of the invention. System 10 includes a light source 11 for projecting light beam 12 along an optical axis V. In a preferred embodiment, two substantially identical planoconvex lenses 14, 15 of selected diameter and focal length focus beam 12 onto a first transparency 17 disposed at the focal plane of lens 15. Suitable spatial filters 18 and 19 having appropriate aperture sizes placed substantially as shown define beam 12 and the portion thereof focused onto transparency 17. Two substantially identical chromatic imaging lenses 21, 22 of selected diametric size and focal length image light from transparency 17 onto transparency 23 disposed at the focal plane of lens 22. Alignment system 24 is operatively connected to transparency 23 to selectively position transparency 23 along axis V. Integrating objective lens system 25 projects an image of susbstantially all light transmission from transparency 23 onto photodetector 27. Photodetector 27 is operatively connected through appropriate current mode operational amplifier electronics 28 to an analog interface that includes an A/D converter 29 and microcomputer 30 so that data defining the output signal of photodetector 27 is reduced and stored in useful format.

Source 11 may be a coherent source, such as a laser, or an incoherent source, such as an incandescent lamp, light emitting diode, or the like. Comparison of the relative advantages and disadvantages of a coherent source versus an incoherent source for use in a representative system 10 built in demonstration of the invention led to the selection of an incoherent source, viz., a (500 watt) frosted incandescent bulb, because use of incoherent light minimizes interference patterns and other diffraction effects between optical components, an incoherent source is relatively inexpensive and has a signal which is linear in intensity, the frosted bulb provides uniformly diffuse illumination, light from an incoherent source is minimally affected by dust or other blemishes on the optical components, and a coherent source may require the recording of phase information whereas an incoherent source is characterized by a real wave intensity distribution.

For other than a point source 11 (i.e., an "extended" source), energy gathered by lenses 14, 15 for imaging onto transparency 17 is directly proportional to aperture size of spatial filter 18, and the flux density is inversely proportional to the square of the magnification of each lens 14, 15. Therefore, maximizing light flux density at the image plane and thereby increasing the speed of the system, make two or more lenses 14, 15 desirable, and demonstration system 10 included two identical planoconvex lenses 14, 15 each having 102 mm diameter and 165 mm focal length (combined focal length 82.5 mm), with the convex vertices in contact. The imaging lens system (21, 22) is preferably of high quality so that minute individual features on the transparencies may be correlated and, accordingly, achromatic lenses were selected and mounted in contact which reduced both spherical and chromatic aberration, preserved high resolution in the image product, and minimized interference pattern formation. Lenses 21, 22 for demonstration system 10 had focal lengths of 660 mm and 280 mm, respectively (197 mm for the combination), and diameters of 83 mm and 63 mm. Lens system 25 was selected as a multielement camera lens of focal length 31 mm and diameter 50 mm. Suitable spacings between components of system 10 were calculated based upon a 31.75 mm object size and image size corresponding to the active diameter (11.28 mm) of the photodetector. Accordingly, the spacing between aperture 18 and lenses 14, 15 was selected at 42 mm, and the spacing between transparency 23 and lens 25 was selected at 120 mm. Photodetector 27 was a planar diffused silicon PIN photodiode (1.0 $cm^2$ active area) manufactured by United Detector Technology Inc. This detector is suited for unbiased operations (a photovoltaic mode) where the dark current and flicker noise are negligible. A Data Translation model DT2782-DI A/D converter system and MDB Systems model MLSI-1123C-R-O microcomputer were used for A/D conversion and data acquisition, handling and storage. Other commercially available components may be usable for photodetection and information processing within the scope of these teachings.

In order to derive accurate data from the analysis of images utilizing the optical correlator of the invention, it is important to accurately align the optical components, including source 11, lenses 14, 15, 21, 22, 25, and photodetector 27 along axis V. Proper alignment minimizes off-axis aberrations, interference effects, vignetting and other inaccuracies. Uniform illumination of the first transparency 17 is highly desirable and, accordingly, in the demonstration system transparency 17 was fixed at a substantially uniformly illuminated porition along axis V and transparency 23 was movable for transparency comparison in practicing the invention.

The optical correlator of the invention may be useful in the analysis of movie images of deflagrating solid propellant surfaces. Transparency alignment in such analyses is difficult since images of burning propellant surfaces lack clear definition and straight edge shapes for reference and alignment purposes. A three axis alignment system 24 was therefore incorporated into system 10 for positioning transparency 23 along axis V and in a plane perpendicular thereto, and for rotating transparency 23 about axis V.

Image analysis according to these teachings utilizes the ability of a lens to form images. With reference again to FIG. 1, if transparency 17 of transmittance f(x,y) is imaged onto transparency 23 of transmittance h(x,y), the intensity I transmitted by both is the product f(x,y)h(x,y) of the two transmittances and an output of lens system 25 and photodetector 27 may be represented as, $$I = I(O,O) = \int\int f(x,y)h(x,y)dxdy \quad (1)$$

The analysis may be performed using either of two optical arrangements. One arrangement is that of FIG. 1 with lenses 21, 22 removed and wherein lenses 14, 15 image light onto transparencies 17, 23 disposed in contact. The intensity product of transparencies 17, 23 is integrated by lens system 25 and photodetector 27 with output defined by Eq (1). This arrangement is not desirable if one transparency is moved during use of the system because of the direct contact between the two. Therefore, system 10 described above in relation to FIG. 1 is the preferred arrangement.

Referring further to FIG. 1, by selectively moving transparency 17, transparency 23, imaging lenses 21, 22 or combination thereof, a multiplicity of one and two dimensional linear transformations may be obtained, including convolutions, correlations, power spectra, filtering, and other useful linear transformations. Consider first a one dimensional convolution and correlation. By translating transparency 23 a distance $x_o$, photodetector 27 outputs yields a one dimensional cross correlation of the form, $$I(x_o) = \int f(x)h(x-_o)dx \quad (2)$$

A one dimensional convolution is obtained by inverting transparency 23 and shifting it a distance $x_o$. Then, $$I(x_o) = \int f(x)h(x_o - x)dx \quad (3)$$

For a two dimensional cross correlation, transparency 23 may be translated in two dimensions, yielding, $$I(x_o, y_o) = \int\int f(x,y)h(x-x_o, y-y_o)dxdy \quad (4)$$

A convolution may be obtained by inverting and translating any one of the two functions. If seriatim frames of a movie are compared, a temporal as well as spatial correlation obtains.

In order to demonstrate utility of the optical correlator of the invention in the statistical analysis of random fields, fifteen different selected frames from front-lit movies of deflagrating solid propellant surfaces taken at various pressures were analyzed. A computer program used in the analyses of data is presented in Appendix A. Characteristic bright features (particle widths) at the deflagrating surface were found to vary with pressure but not with the particle mix of the propellant or with propellant type.

The transmissivity and contrast of an image of a propellant strand is not uniform across the width of the transparency and, therefore, in comparing two images, output from the photodetector indicating a condition of maximum light output does not necessarily indicate that the two images are properly aligned. To minimize background effects, a dark background and several bright features (particles) may be required for reference.

Results were significantly affected by the contrast of the transparency carrying an image of the statistical data. Therefore, in image analysis utilizing the invention, a very high contrast file was used which resulted in substantially pure black or white tones and in signal enhancement from bright intermediate sized features (particles) in the deflagration images. Sharp correlation functions providing direct measure of the sizes of bright features on the deflagrating surface were obtained from the images.

Figure 2:
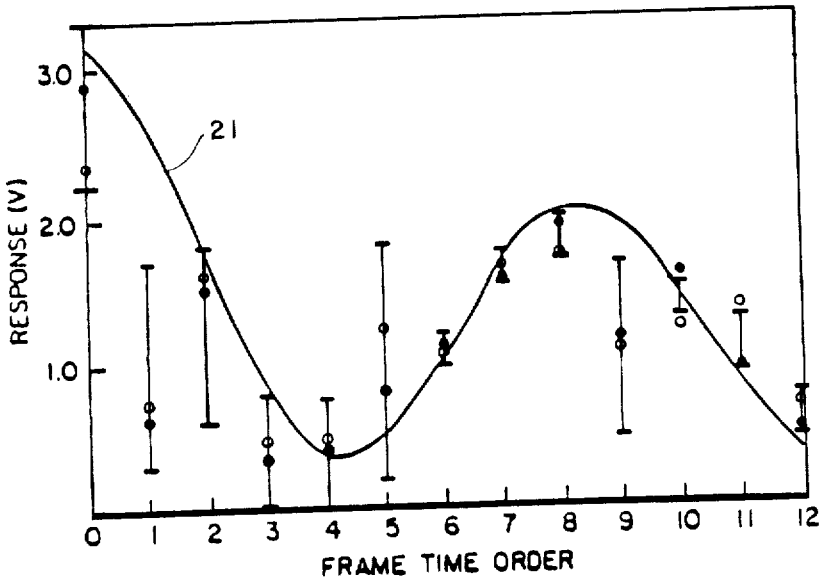
FIG. 2 is a plot of response versus frame time order in the temporal correlation of images of propellant surface burn.

Frames of a movie were compared with respective succeeding frames to obtain a temporal as well as spatial correlation. The plot of the highest response of each frame versus the frame time order was also expected to be in the shape of an exponential decay, which would result from the decrease in particle size during burn. A damped cosine function 21 resulted, as presented in FIG. 2. The result implies that an oscillation is associated with the combustion process, and the data represents a quantitative verification of this result. A best curve fit for the data was made using a standard (chi)$^2$ fitting routine. The specified function to which the data best fit was a damped cosine curve of the form, $$f(t)=A(B+\cos\omega t)e^{-\nu t} \quad (5)$$

where A is the initial peak amplitude, B is a dc offset to the oscillation amplitude, $\omega$ is the oscillation frequency and $\nu$ is the damping rate. The optimized parameters were A=1.4, B=1.31, f=0.118, and $\nu$=18.8; a 97% probability resulted that the data were nonrandom.

Figure 3:
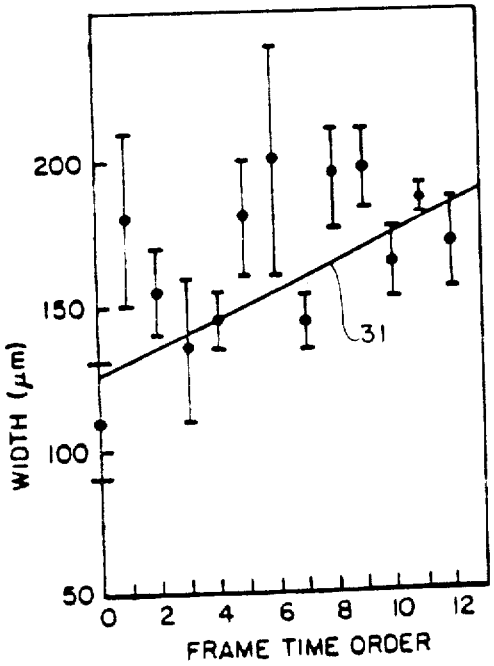
FIG. 3 is a plot of correlation function width versus frame time order in comparison of frames in a sequence of images of propellant surface burn.

A similar analysis was used to measure the trend in the widths of the correlation functions versus time. FIG. 3 shows a plot 31 of cross correlation function width versus separation in time in comparing seriatim frames of a movie. Although some scatter exists in the data, the widths of the cross correlation functions increase with time between frames, which indicates movement in the apparent location of the bright features at the surface. To obtain a best data fit, a standard linear regression routine was used to make a $$f(t)=mt+b \quad (6)$$

least squares fit to the data with a straight line, where m is the slope and b the y intercept of the fitted line. Use of various weightings for the y values represented by the bars on the plot resulted in an output of m=4.68 and b=126.8; the probability that the data points were not correlated was only 0.4%.

The invention as herein described therefore provides a novel optical correlator for analysis of random fields, such as that of surface deflagration, wind tunnel flow, spray behavior, or other turbulent random phenomena. Modifications of the invention as described may be made, as might occur to the skilled artisan, within the scope of the appended claims, and, therefore, all embodiments comtemplated hereunder which achieve the objects of the invention have not been shown in complete detail. Other embodiments may be developed without departing from the spirit of the invention or from the scope of the appended claims.

APPENDIX A
I/O A/D AND DATA FILE ROUTINES

```
PROGRAM DATAQU
INTEGER*2 IDAT, DIST, IDIST,L
REAL JDAT, IBOU
DIMENSION JDAT(200),DIST(200)
COMMON / IBOU/ IDAT
TYPE*,'INPUT THE NUMBER OF POINTS (N):'
READ(5,5) N
FORMAT(I4)
TYPE*,'THE STEP VALUE (K):'
READ(5,6) K
FORMAT(I4)
IDAT=0
IDIST=-K
DO 10 I=1,N+1
JDAT(I)=0.
DIST(I) = 0
CONTINUE
L=0
DO 400 I=1,N
IDIST=IDIST + K
DIST(I)= IDIST
TYPE*,' '
WRITE(5,60)
```

```
60          FORMAT(1X, 'PRESS RETURN TO TAKE A DATA POINT')
            READ(5,70) IAN
70          FORMAT(A2)
            IF (IAN.EQ.'N') GOTO 300
            CALL GETDAT
            WRITE(5,80)
80          FORMAT(1X,'DONE')
            JDAT(1) = .00120*IDAT
            WRITE(5,81) DIST(I),JDAT(I),idat
81          FORMAT(1X,I8,4X,F10.4,i8)
            IDAT = 0
            GOTO 400
300         TYPE*,' '
            N=N+1
            IDIST=IDIST-K
            DIST(I) = DIST(I) - K
            TYPE*, '***************************'
            WRITE (5,83)
83          FORMAT(1X,'DO YOU WANT TO TAKE CHANGE THE STEP
            VALUE (Y/N)?')
            READ (5,84) KYN
84          FORMAT(A2)
            IF (KYN.EQ.'N ') GOTO 400
            TYPE*,'INPUT THE NEW SPACING:'
            READ (5,100) K
100         FORMAT (I4)
            IDIST = IDIST + K
            DIST(I) = IDIST
            GOTO 50
400         CONTINUE

NOW FILE THE DATA IF DESIRED

500         TYPE*,' '
            WRITE (5,85)
85          FORMAT(1X,'DO YOU WANT TO SAVE THE DATA (Y/N?')
            READ (5,86) JYN
86          FORMAT(A2)
            IF (JYN.NE.'N ') CALL DATFIL
            WRITE(5,90)
90          FORMAT(1X,'PROGRAM FINISHED!!')
            STOP
            END
            subroutine datfil
            common Jdat(200),dist(200),N
            dimension dat(3),head(5)
            integer*2 dist
            real jdat
            double precision fname,ihead(9)
            type*, ' '
            type*, ' Insert a formatted disk into one of the
            disk drives.'
            type*,'The file name must begin with the device
            name'
            type*,'(DYO:  for the upper drive, DY1: for the
            lower disk drive)'
```

```
                type*,'which is followed by a file name of up to
                four letters.'
                type*,' '
                type*,'Input the name of the file:',
                read(5,100)fname
100             format(a8)
                open(unit=2,name=fname)
                type*,' '
                type*,'Input the heading to be given to the
                data file (20 char):'
                read(5,105)(head(k), k=1,5)
105             format(5a4)
                call date(dat)
                write(2,104)(head(j), j=1,5),(dat(i), i=1,3)
104             format(1x,5a4,7hTAKEN  ,3A4)
                type*,' '
                type*,'Input any comments on this data file(72
                characters):'
                read(5,101)(ihead(k), k=1,9)
101             format(9a8)
                write(2,102)(ihead(l), l=1,9)
102             format(1x,9a8)
                do 200 k=1,N+1
                write(2,103) dist(k),jdat(k)
103             format(1x,i8,4x,f10.4)
200             continue
                return
                end
                .TITLE  GETDAT
                .MCALL  .PRINT
                .GLOBL  GETDAT, IBOU
GETDAT:         MOV #0, @#170402
                MOV #0, RO
                MOV #IBOU,  RO
                MOV #401, @#170400
BINTST:         TSTB @#170400
                BMI  GDAT
                BR BINTST
GDAT:           TST  @#170400
                BMI  ERROR
                MOV @#170402, @RO
                RTS PC
ERROR:          .PRINT  #ERRMES
                RTS  PC
ERRMES:         .ASCII  /ANALOG INPUT INCOMPLETED?/
                .PSECT IBOU, D,GBL,OVR
IBOU:           .WORD    1
                .END
```

We claim:

1. An optical correlator for analyzing images of random fields, comprising:

(a) a light source for projecting a beam of light along a preselected optical axis;

(b) a first lens system disposed along said axis for receiving said beam and focusing said beam on a first image disposed at the focal plane of said first lens system;

(c) a second lens system disposed along said axis for receiving light transmitted by said first image and focusing said light transmitted by said first image onto a second image disposed at the focal plane of said second lens system;

(d) a third lens system disposed along said axis for receiving light transmitted by said second image and projecting said light transmitted by said second image along said axis; and (e) a photodetector disposed along said axis for receiving light projected by said third lens system and providing an output signal corresponding to said light projected by said third lens system.

2. The optical correlator as recited in claim 1 further comprising electronic means operatively connected to said potodetector and responsive to the output signal therefrom for analyzing said output signal and displaying said output signal in useful format.

3. The optical correlator as recited in claim 1 further comprising a first spatial filter disposed near said light source for defining the spatial extent of said beam received by said first lens system.

4. The optical correlator as recited in claim 3 further comprising a second spatial filter disposed near the focal plane of said first lens system for defining the spatial extent of said beam focused on said first image.

5. The optical correlator as recited in claim 1 further comprising alignment means for operative attachment to the second image for selectively positioning the second image relative to said axis near the focusing plane of said second lens system.

6. The optical correlator as recited in claim 1 wherein said light source is an incoherent source.

7. The optical correlator as recited in claim 6 wherein said first lens system comprises two substantially identical planoconvex lenses of preselected diameter and focal length with the respective convex vertices thereof in contact, said second lens system comprises two achromatic planoconvex lenses of respective preselected diameters and focal lengths disposed along said axis with the respective convex vertices thereof in contact, and said third lens system comprises a multielement camera lens of preselected diameter and focal length.

8. An optical correlator for analyzing images of random fields, comprising:

(a) a incoherent light source for projecting a beam of incoherent light along a preselected optical axis;

(b) a first spatial filter disposed near said source for defining the spatial extent of said beam projected by said source along said axis;

(c) a first lens system disposed along said axis for receiving said beam and focusing said beam on a first image disposed at the focal plane of said first lens system;

(d) a second spatial filter disposed near the focal plane of said first lens system for defining the spatial extent of said beam focused on said first image;

(e) a second lens system disposed along said axis for receiving light transmitted by said first image and focusing said light transmitted by said first image onto a second image disposed at the focal plane of said second lens system;

(g) alignment means for operative attachment to the second image for selectively positioning the second image relative to said axis near the focusing plane of said second lens system.

(h) a third lens system disposed along said axis for receiving light transmitted by said second image and projecting said light transmitted by said second image along said axis;

(i) a photodetector disposed along said axis for receiving light projected by said third lens system and providing an output signal corresponding to said light projected by said third lens system; and (j) electronic means operatively connected to said photodetector and responsive to the output signal therefrom, said electronic means including an amplifier and an analog-to-digital converter for analyzing said output signal and displaying said output signal in useful format.

9. The optical correlator as recited in claim 8 wherein said incoherent light source is an incandescent source.

10. The optical correlator as recited in claim 9 wherein said first lens system comprises two substantially identical planoconvex lenses of preselected diameter and focal length with the respective convex vertices thereof in contact, said second lens system comprises two achromatic planoconvex lenses of respective preselected diameters and focal lengths disposed along said axis with the respective convex vertices thereof in contact, and said third lens system comprises a multielement camera lens of preselected diameter and focal length.

* * * * *

UNITED STATES PATENT AND TRADEMARK OFFICE

CERTIFICATE OF CORRECTION

PATENT NO. : 4,723,222

DATED : February 2, 1988

INVENTOR(S) : Roger J. Becker et al

It is certified that error appears in the above-identified patent and that said Letters Patent is hereby corrected as shown below:

Column 1, line 18, "behaviour" should be --- behavior ---.
Column 1, line 51, "allow" should be --- allows ---.
Column 1, line 66, "procide" should be --- provide ---.
Column 2, line 59, "susb-" should be --- sub- ---.
Column 3, line 24, "make" should be --- makes ---.
Column 3, line 68, "porition" should be --- position ---.
Column 4, line 43, "outputs" should be --- output ---.
Column 4, in equation (2) at line 46, "$f(x)h(x-_o)dx$" should be --- $f(x)h(x-x_o)dx$ ---.
Column 5, line 15, "file" should be --- film ---.
Column 6, line 16, equation (6) should appear after the line "least squares fit to the data with a straight line,".
Column 6, line 29, "Modifications of" should be --- Modifications to ---.
Column 6, line 32, "comtemplated" should be --- contemplated ---.
Column 11, line 5, in claim 2, "potodetector" should be --- photodetector ---.

Signed and Sealed this

Fifth Day of July, 1988

*Attest:*

*Attesting Officer*

DONALD J. QUIGG

*Commissioner of Patents and Trademarks*